US006410878B1

(12) United States Patent
Guerin et al.

(10) Patent No.: US 6,410,878 B1
(45) Date of Patent: Jun. 25, 2002

(54) METHOD FOR PRODUCING A FLAME SUPPORT

(75) Inventors: William Guerin, Paris; Valerie Bosso, Ermont; Daniel Confrere, La Varenne-Saint-Hilaire; André Walder, L'Hay-les-Roses, all of (FR)

(73) Assignees: Gaz de France (GDF) Service National, Paris; Office National d'Etudes et de Recherches Aerospatiales - Onera, Chatillon, both of (FR)

( * ) Notice: Subject to any disclaimer, the term of this patent is extended or adjusted under 35 U.S.C. 154(b) by 0 days.

(21) Appl. No.: 09/719,659

(22) PCT Filed: Apr. 14, 2000

(86) PCT No.: PCT/FR00/00973

§ 371 (c)(1),
(2), (4) Date: Feb. 13, 2001

(87) PCT Pub. No.: WO00/63617

PCT Pub. Date: Oct. 26, 2000

(30) Foreign Application Priority Data

Apr. 16, 1999 (FR) ..... 99 04804

(51) Int. Cl.[7] ..... B23K 11/00; B21J 1/06

(52) U.S. Cl. ..... 219/117.1; 219/113; 219/149

(58) Field of Search ..... 219/113, 117.1, 219/149, 78.01

(56) References Cited

U.S. PATENT DOCUMENTS 3,113,202 A * 12/1963 Nolen et al.
3,150,711 A 9/1964 Brown et al.
3,242,562 A * 3/1966 Kraft
3,437,783 A * 4/1969 Lemelson
3,670,137 A * 6/1972 Inoue
3,680,183 A 8/1972 Sundberg et al.
4,788,406 A * 11/1988 Holman et al.
5,524,704 A 6/1996 Stouvenot

FOREIGN PATENT DOCUMENTS

| | | | |
|---|---|---|---|
| EP | 0 329 863 A | | 8/1989 |
| GB | 1 455 705 | | 11/1976 |
| JP | 405212548 A | * | 8/1993 |
| WO | WO 93 18342 A | | 9/1993 |
| WO | WO 94 14608 A | | 7/1994 |
| WO | WO 99 18393 A | | 4/1999 |

OTHER PUBLICATIONS

Derwent Acc–No: 2000–672759 Bosso et al. (May 2000).*

* cited by examiner

*Primary Examiner*—Tom Dunn
*Assistant Examiner*—Kiley Stoner
(74) *Attorney, Agent, or Firm*—Skinner and Associates

(57) ABSTRACT

The invention concerns a method for producing a flame support for a gas burner, which consists in producing disjointed metal fibres (10) in an alloy comprising iron, chromium and aluminium; assembling the fibres together under pressure; bringing the fibre mat to a temperature sufficient to ensure a close bonding between the fibres. The invention is characterised in that it consists in feeding said metal alloy to an overflowing tank (3), to produce the fibres by cooling in contact with a mobile wheel (7); then in arranging in a moulding matrix the resulting disjointed fibres (10) and compressing them to form an agglomerated mat; then in connecting the mat to electrodes and a capacitor, thereby bringing the fibres (10), at their points of contact, to a temperature not less than their melting point, to produce fibres closely welded together, under high voltage.

3 Claims, 3 Drawing Sheets

METHOD FOR PRODUCING A FLAME SUPPORT

Figure 1:
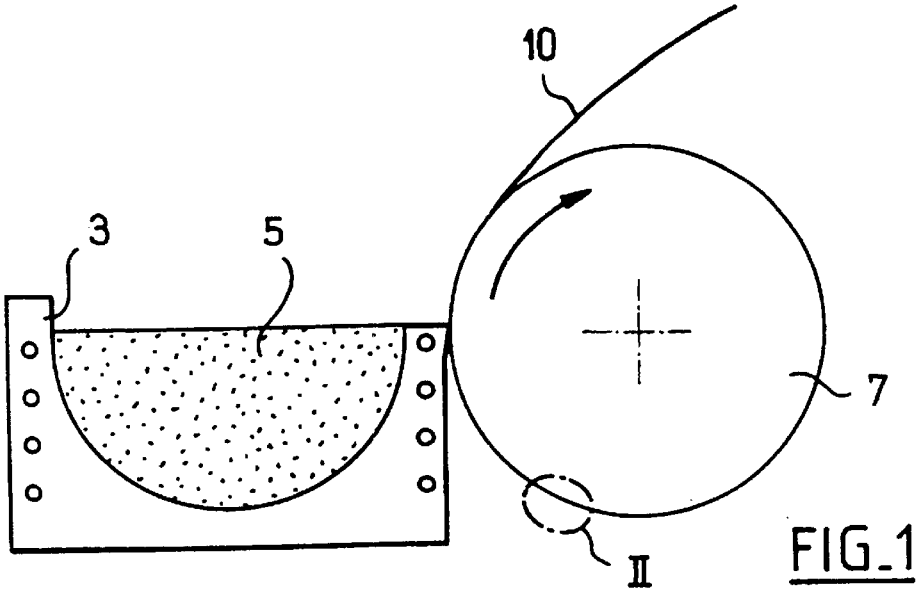

The field of the invention relates to flame supporting elements for burners, notably premixing burners fed with a combustible gas.

The Prior Art suggests various types of flame supporting elements for stabilizing the flames and for improving the development of said flames.

Such flame supporting elements are designated by other expressions such as <<burner membrane>>, <<porous metal fiber plate>> or <<combustion head>>.

The flame supporting elements are typically made of materials such as ceramic or metal. They are porous or have holes therein for enabling the gas to pass therethrough.

In the burners, the flame supporting elements are typically interposed between the distribution chamber and the combustion chamber.

In U.S. Pat. No. 3,680,183, is disclosed a process for manufacturing such a flame supporting element for burner.

According to said process:

a) distinct metallic fibers are made from a metallic alloy heatproof up to at least substantially 750° C. and comprising iron, chromium and aluminum, b) the distinct metallic fibers are joined to each other, under a determined pressure, for creating a mat of agglomerated fibers, and c) the mat of agglomerated fibers is heated to a temperature which is sufficient for intimely joining the agglomerated fibers forming the mat, at zones where said fibers intersect.

Even if the disclosure of the above US patent relates to a burner, it does not specifically concern a gas burner. And various drawbacks are considered in the invention as being to be absolutely solved, as regards the state of the Art.

So, an object of the invention is to provide gas burners with a flame supporting element fulfilling the following features:

a flame support element adapted for operating as in a <<blue flame>> mode (the flames are typically located outside the flame supporting element) as in a radiant mode (the flames penetrate within the flame supporting element), easiness and swiftness for manufacturing the flame support element, reliability of the flame supporting element (resistance to oxidation, mechanical strength, emission of pollution, variability of power the modulation of the power should reach 1 to 10, even 1 to 30), quality of the flame supporting element as manufactured, especially in consideration of the mechanical features and elasticity, cost price as low as possible, variability in the shape of the flame supporting element.

The solution as proposed by the invention for satisfying at least some of the above features, consists in:

during the above step a), providing a tank containing a metallic alloy having an aluminum content higher than substantially 4% in weight (or even 5%), the tank being heated up to a temperature higher or equal to the temperature for fusing said metallic alloy, setting a contact between said fused metallic alloy and movable extracting means, so that the movement of the extracting means induces a determined quantity of said fused (melted) metallic alloy to adhere the surface thereof, to be extracted from the tank, then to be cooled, for solidification, at first on said surface of the extracting means, then in air (or in a neutral gas), when said quantity of extracted metallic alloy has left the surface of the extracting means under the effect of a separating force induced by the movement of the extracting means, during step b), the distinct metallic fibers (which are typically still individualized and which are in a dry state, as obtained from the step a)) are disposed in a mold where they are substantially uniformely compressed for forming said agglomerated mat, in such a way that the gas porosity in the mat is substantially uniform, and, during step c), no pressure notably higher than the pressure exerted during step b) is exerted to the compressed fibers of said agglomerated mat, the mat of the compressed fibers is connected to electrodes and to a capacitor, and through said electrodes and by electrically discharging the capacitor, the compressed fibers of the mat are heated at the points where they are in electrical contact to each other, to a temperature higher or equal to their temperature of fusing, for inducing a welding of the fibers to each other, exclusively, under a <<high voltage>> (at least substantially 1000 Volts), so that the gaseous porosity of the mat comprising said metallic fibers welded to each other is substantially uniform and substantially equal to the gas porosity of the agglomerated mat obtained from step b).

By using such a process:

the steps for manufacturing the mat of fibers are reduced (only one step is useful for manufacturing the mat of compressed fibers, by using <<dry>> metallic fibers originally distinct one from the other), a mat having high thermical and mechanical performances is obtained, during step a), valuable metallic fibers are manufactured, and during the further steps of manufacturing the thermical and mechanical performances of such fibers are maintained, with no alteration of those performances during the step of compressing or the step of intimely mechanically connecting the fibers to each other, the manufactured flame support element has an homogeneous gas porosity, what is in favor of the optimization of the gas burner, the mechanical strength of the flame supporting element is improved.

It will also be noted that the above-mentioned expression <<(welding)>> (the agglomerated fibers of the mat are welded to each other) specifically relates to welding said fibers exclusively one to the others, at a temperature at least equal to their temperature of fusing, what is really different from sintering the fibers. Further, such a <<welding>> is, in the present case, more specifically a welding induced by electrically discharging a capacitor, what is completely different from a welding obtained by using a welding machine comprising an electrical transformer which delivers an electrical voltage very lower than the above-mentioned <<high voltage>> (a few dozens to a few hundreds of volts, only, what is not presently appropriate, as regards the required mechanical and thermical features, together with the performance of a qualified flame supporting element in a gas burner).

According to the invention, the welding of the metallic fibers is operated at a voltage of at least 1000 Volts (typically a few thousands, or even a few tens of thousands, of Volts) under an intensity of at least 100 A (the intensity can be higher than 10 000 A), during a period of time of about 10 to 20 micro-seconds.

It is further to be noted that another feature of the invention preferably requires that during the step a), the metallic fibers as manufactured contain preferably between 5.5 and 8% in weight of aluminum.

For favorizing the circulation of the gaseous fluid through the flame support element, the fibers as obtained from step a) will preferably be elongated fibers showing a transversal section having a shape of lunule (viz. lenticular or <<crescent >>-shaped) such a shape defining a hollow canal (on the concave face).

Along the transversal section, the outer cord of such fibers will preferably be comprised between 300 microns and 3000 microns (average value typically about 800 $\mu$m), and an average height of about 20 to 200 $\mu$m. The length of the fibers will preferably be comprised between 0.7 cm and 15 cm, and advantageously higher than 1 cm. As regards the gas porosity of the flame supporting element, said porosity will preferably be comprised between substantially 60% and 95%. Metallic fibers will then be preferably isotropically dispersed in the mat, and the flame supporting element will be adapted to be used, as in an air atmospheric burner, as in a pressurized air burner.

For manufacturing the above-mentioned metallic fibers, the above-mentioned <<extracting means>> preferably comprise a wheel having a peripheral surface provided with grooves (or indentations) regularly spaced and individually provided with a thin line. The wheel is rotated and the thin line of every groove is brought substantially to the same level than the melted metal, so that every groove extracts a determined quantity of metallic alloy, said quantity being substantially equal to the quantity useful for manufacturing the metallic fibers, once the metal is cooled and solidified.

It is also to be noted that the conditions of molding the fibers under pressure and/or welding them one to the other will be different, as a function of the gaseous porosity of the flame supporting element: if the gas porosity is comprised between about 60% and 80% to 85%, then, the molding under pressure will be operated within the mold. However, the welding operation will operate out of the mold (the walls of the welding apparatus will then be electrically insulated ; the electrodes only will be electrically conductive).

The heating temperature at the points (or zones) where the fibers are in contact to each other will typically reach, or be higher than, 1450° C.

If the gas porosity is higher than above (about 85% to 95%), both the molding and the welding operation will operate within the molding apparatus (still having a non electrically conductive wall). The temperature will substantially be equal to the above-mentioned one.

Figure 2:
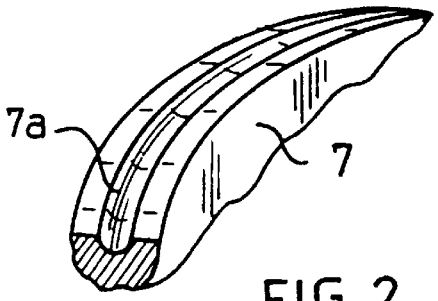
Figure 3:
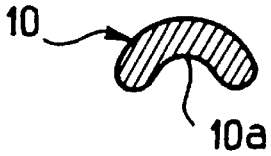
Figure 4:
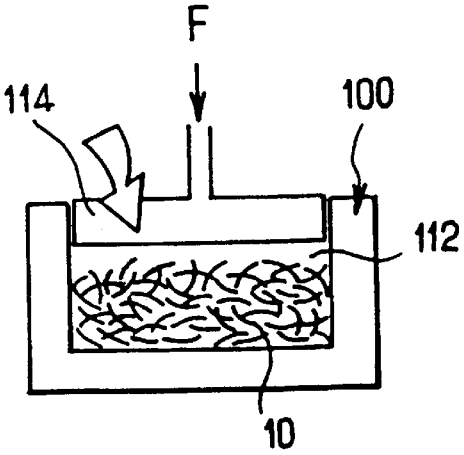
Figure 5:
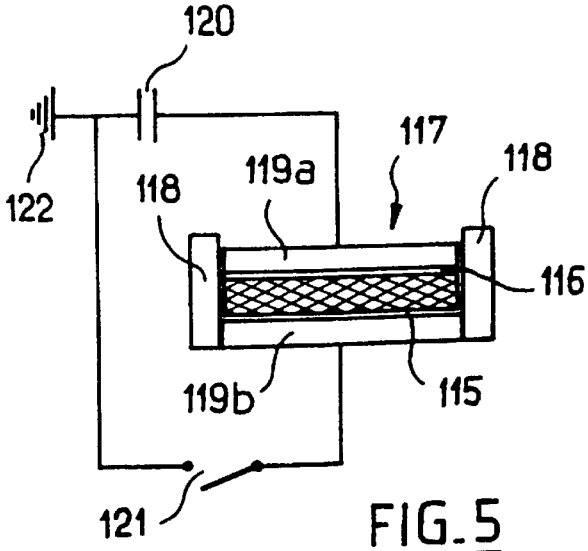
Figure 6:
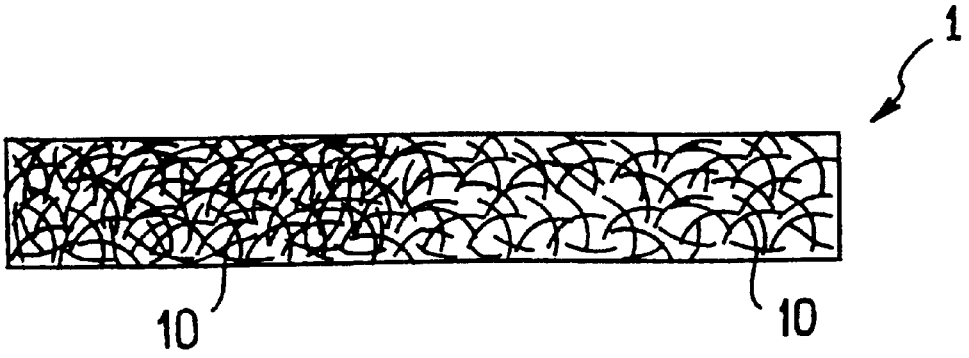
Figure 7:
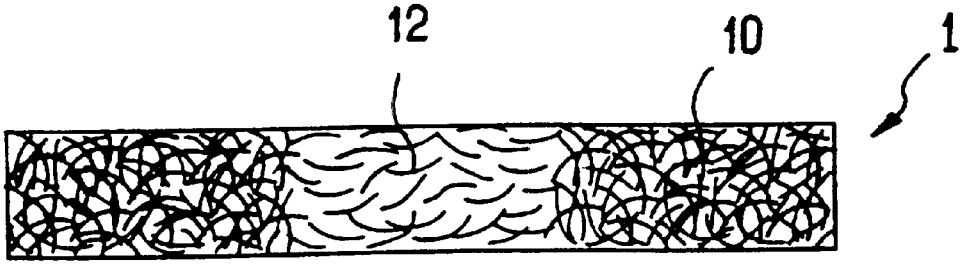
Figure 8:
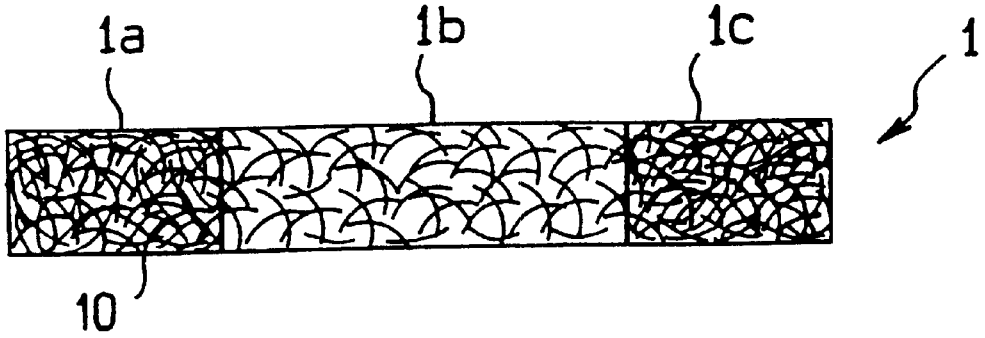
Figure 9:
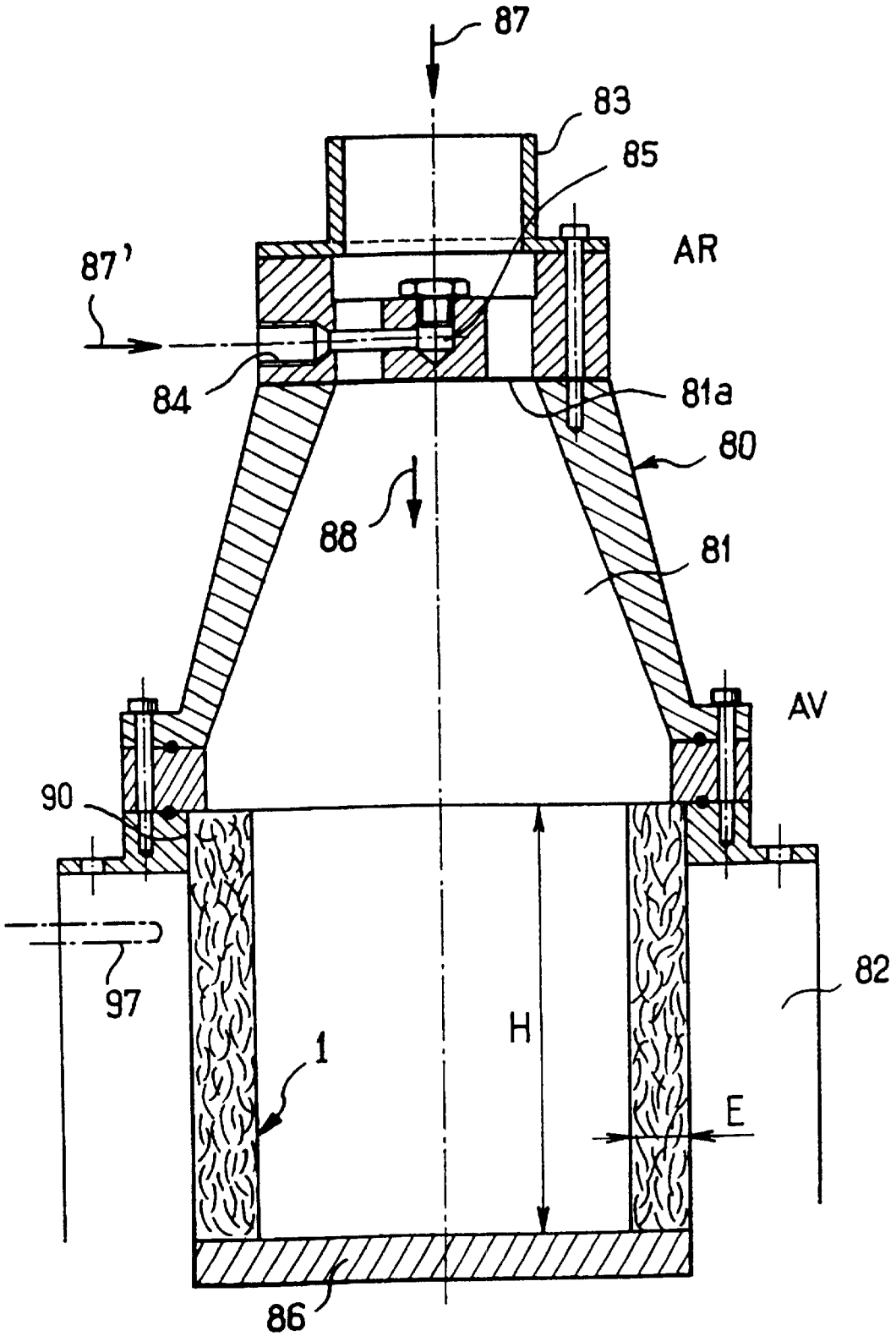

A more detailed description follows hereafter, in relation to the enclosed drawings, wherein:

FIG. 1 diagrammatically shows general steps for manufacturing metallic fibers by means of a <<melt overflow>> process (the metallic alloy in fusion overflows), FIG. 2 is a detail at a larger scale of zone II of FIG. 1, FIG. 3 is a very large scale view, in section, of a fiber having a <<crescent-shape>> as obtained by using a <<melt overflow>> process diagrammatically illustrated in FIG. 1, FIG. 4 diagrammatically shows a molding apparatus for compressing the fibers and obtaining a mat of fibers, FIG. 5 diagrammatically shows a welding system for welding such a mat by means of electrically discharging a capacitor, FIG. 6 is a section of a flame supporting plate having a variable porosity, FIGS. 7 and 8 are two embodiments of the plate illustrated in FIG. 6, and FIG. 9 is a section of a burner provided with a flame supporting element corresponding to the invention.

FIGS. 6 to 8 show a flame supporting plate 1, the shape of which is parallelipedic. The plate 1 comprises a plurality of thin fibers 10 made of metallic alloy FeCrAIX (X=itrium or a rare earth, or even a mixing of rare earths, such as cerium or herbium, or <<mischmetal>>), for example a stainless steel having a high content of aluminum (about 7% in weight). The fibers are compressed so that the definitive shape of the plate is obtained.

A tank filled with a metallic alloy is typically used for obtaining the fibers 10. The metallic alloy (such as a heat refractory stainless steel) is heated to a temperature higher or equal to its melting temperature, so that the alloy is liquified.

A movable extraction means is started and disposed in contact with the above-mentioned metallic alloy, so that the movements of said extraction means (which can be a rotation or a translation) extracts a determined quantity of melting metal from the tank. The melting metal adheres on a peripheral surface (typically a very thin surface) of the extracting means. Then, the melted metal is cooled on the moving extraction means. Afterwards, it is ejected from the surface of the extracted means by a force induced by the movement of said extracting means (centrifugal force if the movement is a rotation). Then, the metal solidifies very swiftly in air (cooling of tenth thousand of degrees per second) or in a neutral gas (for example argon), so that an elongated filament is formed. Preferably, and as described below, the extraction means comprise a wheel adapted to rotate round an axis. The wheel is provided with a discontinuous surface of contact, for example comprising regularly spaced grooves or teeth.

For satisfying as far as possible the instructions written at the beginning of the description, the <<melt-overflow>> process is selected. According to such a process (see FIG. 1), a tank 3 is filled with the metallic alloy 5, said alloy being adapted for manufacturing the fibers. The metallic alloy 5 is heated for obtaining a bath of melted metal. The bath slightly and permanently overflows, and a grooved wheel 7 is disposed substantially on a level with the overflowing zone of the tank, so that when the wheel is rotating at a high speed, a determined quantity of liquid metal is extracted from the tank : the liquid metal adheres to at least one of the abovementioned grooves disposed at the periphery of the wheel, such as the groove referenced 7*a* in FIG. 2. Then, this determined quantity of melted material solidifies, while cooling on the wheel for forming a fiber 10 having a crescent-shaped section (also called lenticular section) as illustrated in FIG. 3, having an inner concave surface 10*a* suitable for having a fluid (gas) flowing through the flame supporting element. Thereafter, the centrifugation of the wheel induces an ejection of the <<fiber>> from the wheel. The fiber is ejected in air or in a protecting neutral gas where said fiber cools in the end, for defining the illustrated metallic fiber having such a <<crescent>> section and the length of which corresponds to the length of the groove from which the fiber has been formed.

Even if the <<melt extraction>> process has a lower performance, such a process can be used: A wheel provided with grooves (or indentations) is rotated above the heated tank still containing a bath of melted metallic alloy. The wheel is slightly dipped into the bath and is rotated therein, so that a determined quantity of bath material adheres to every groove (or indentation) and is extracted from the bath for forming a meniscus on said groove. The meniscus as formed begins to cool in the groove and to solidify therein, while the wheel is rotating. Then the centrifugation force on the wheel ejects the meniscus from said wheel, through air (or a neutral gas such as argon), where the material solidifies in the end for forming the definitive metallic fiber.

Once the filaments (or elongated fibers) are obtained, a mat of such fibers is formed in a mold (or a drop forging press) 100 illustrated in FIG. 4: The fibers are disposed into a cavity 112 of the mold and a compressing force F is applied to the fibers, by means of a movable punch 114, so that a mat of compacted fibers 115 is obtained (see FIG. 5) having the required shape. The shape of the mat can be parallelipedic, circular, or even conical or annular. The shape of the mat is the definitive shape of the flame supporting element. Typically, the degree of gas porosity of said compressed mat is the one of the definitive flame supporting element (60% to 95%).

During a previous step, the fibers 10 may have been cut or grinded (especially if the fibers has a length of a few centimeters to tenths of centimeters), so that the fibers are more easily dispersed in the cavity 112.

Typically, the fibers are screened before being disposed in said cavity, so that they are calibrated as a function of the requirements for the flame supporting element.

If the degree of porosity of the compressed mat 115 is lower than substantially 85% (to within a few percents), the step of consolidating the mat by means of the welding step is operated out of the mold, as illustrated in FIG. 5.

In such a situation, the mat 115 is disposed in the internal space 116 of the welding machine 117 operating through the discharge of a capacitor. The inner space 116 of such a machine is fitted to the shape and dimensions of the mat (to which no additive mechanical compression stage is exerted in the mold). The welding machine comprises electrically insulated lateral walls 118 together with two electrodes 119*a*, 119*b* between which the mat 115 is interposed. The electrodes, together with the lateral walls 118, define the welding space 116. The electrodes 119*a*, 119*b* are connected to a capacitor 120. A switch 121 is interposed on the electrical circuit. The reference 122 shows the earth. The electrodes are in electrical contact with the metallic fibers of the mat, so that passing to<<on>> the switch 121 induces the capacitor 120 to discharge. The capacitor together with the other electrical elements of the circuit, is dimensioned to deliver thousands, or even tenths of thousands, of Volts, and an intensity specifically equal to thousands of Amperes, or even tenths of thousands of Amperes, to the points (or zones) where the fibers intersect. The time interval of the welding is of about one to tenths of microseconds. Comparatively, time intervals typically longer than a second, voltages of about tenths of Volts, or a welding using an electrical transformer, are not presently appropriate, because of the features of the flame supporting element to be manufactured.

Especially, such a welding operation obtained by means of an electrical discharge of the capacitor ensures that a large majority (preferably more than 90%) of the fibers are welded to each other at at least two points of intersection, what gives a reliability and a mechanical resistance valuable for the flame supporting element. Further, the conditions for such a welding (which is not a sintering, since the temperature of fusing the fibers to each other is locally reached, even if the global temperature of the mat is notably lower than 100° C., such as 50° C. to 60° C.) enables a <<usual >> welding apparatus to be used : walls of a high temperature resistivity are not compulsory, so that the cost of the welding apparatus is low (the walls 118 can be made of a plastic material).

If the fibers are compressed in the cavity 112 to a pressure as high as the gaseous porosity of the mat is higher than substantially 85%, then, the welding of the fibers to each other should preferably be operated within said mold. To that aim, the mold 100 illustrated in FIG. 4 should be provided with two electrodes facing to each other and an electrical circuit including a capacitor 120 would be connected accordingly.

Further, with such a process, the fibers are manufactured in an alloy including a high content of aluminum, while the fibers are non brittle and can be manufactured at a low cost.

Flame supporting elements having a variable gaseous porosity can be also obtained.

To that aim, the pressure exerted to some zones of the fibers within the cavity of the molding apparatus is increased. It is also possible to increase the quantity of fibers disposed locally in the cavity. A section of such a plate 1 obtained by using such a specific local pressure or local dispersion is illustrated in FIG. 6.

It is further possible to manufacture fibers 10 and 12 having different diameters. The thinner fibers can be disposed in at least one zone where a lower porosity is to be obtained. A section of a circular plate 1 having such a dispersion is illustrated in FIG. 7 where the thicker fibers (in diameter) are disposed essentially at the centre of the plate.

The mold referenced 100 enables the flame supporting element to directly get its definitive shape (cylinder, ring, annular cylinder . . . ). Further, said flame supporting element can directly have its definitive gaseous porosity, and even its definitive mechanical cohesion, if the welding of the fibers to each other is operated within the mold.

For larger flame supporting elements, successive supports 1*a*, 1*b*, 1*c* can be connected end to end. Each element (support) can have a specific gaseous porosity for forming a large plane plate showing a variable gaseous porosity (FIG. 8).

Since it is possible to obtain fibers having a variable composition from the above-mentioned process, the corresponding flame supporting elements comprising those fibers can have different metallic compositions obtained by homogeneously mixing the fibers or by disposing different types of fibers in specific zones of the cavity for obtaining a plate having variable physical features.

Thus, for a circular plate, it could be advantageous to dispose heatproof fibers at the center of the plate (where the flame is aggressive at the most) while disposing less heat-resistive fibers at the periphery of the plate.

For example, FIG. 9 illustrates a possible flame supporting element made of a metallic alloy FeCrAIX obtained from the abovementioned process and including substantially 7% of aluminum.

In said FIG. 9, a flame supporting element is fixed in a well-known burner referenced 80. It can be a domestic burner provided with a premixing flow of air and combustible gas. The flames can be <<blue flames>>.

The burner referenced 80 essentially comprises a mixing chamber 81 having the shape of a frustroconical box having a substantially circular section. The mixing chamber has a rear face 80*a* (smaller section of the truncated cone) where the mixing chamber is connected to the separated feeding pipes 83, 84 adapted for feeding the burner with air and a combustible gas. In said figure, the terms AV and AR respectively locate the front and back of the burner, with reference to the flowing of the mixing fluid through the burner, as shown by the arrows 87, 87' and 88. The mixing chamber 81 is separated from the combustion chamber 82, on its front face, by the flame supporting element 1. As illustrated, the flame supporting element has a hollow cylindrical shape, the height of which is H and the thickness of which is E. A solid plate 86 frontally closes the free end of support 1. As shown, the combustible gas feeding pipe 84 intersects the pressurized air feeding pipe 83, upstream the mixing chamber (85).

A blower can be disposed upstream the pipe 83 or upstream the combustion chamber.

However, a non pressurized air feeding can be used (the burner will then be an air atmospheric burner).

As illustrated, an electrode 97 connected to a high voltage electrical power system is adapted for igniting the burner.

Upon ignition of the burner, the combustion products are dispersed outside the flame supporting element, while the gaseous mixed fluid is passing through the center of the element.

An annular cylinder having a inner diameter of 50 mm, an outer diameter of 70 mm and a height of 15 mm was tested. Such an element had a heating surface of 3 297 $mm^2$. In a radiant mode, the minimal power was of 2 kW (viz. a power per surface unit of 607 $kW/m^2$).

The maximal power (blue flame) was of 30 kW (viz. a power persurface unit of 9 099 $kW/m^2$).

So, the modularity of the burner was comprised between 2 and 30 kW, viz. a ratio comprised between 1 and 15.

The emission of carbon monoxide (CO) was substantially equal to zero, and the emission of NOx was lower than 60 mg/kWh, for an average ratio of about 30%.

According to another embodiment, the structure of the flame supporting elements can be obtained from successive porous rings coaxially stacked and separated two by two by a full non porous strut, or by a circular plate, or even by other separating means.

What is claimed is:

1. A process for manufacturing a flame supporting element, for a burner fed with gas, the process comprising the following steps:

a) making distinct metallic fibers from a metallic alloy heatproof up to at least substantially 750° C. and comprising iron, chromium and aluminum, b) joining the distinct metallic fibers under a determined pressure, creating a mat of agglomerated fibers, and c) heating the mat of agglomerated fibers to a temperature which is sufficient for intimely joining the agglomerated fibers which forms the mat, at zones where said fibers intersect, wherein during the step a):

providing a tank containing a metallic alloy having an aluminum content higher than substantially 4%, heating the tank up to a temperature higher or equal to the temperature for fusing said metallic alloy, setting a contact between said fused metallic alloy and a surface of movable extracting means, so that the movement of the extracting means induces a determined quantity of said fused metallic alloy to adhere the surface thereof, to be extracted from the tank, then to be cooled and solidified at first on said surface of the extracting means, then in air, or in a neutral gas, when said quantity of extracted metallic alloy has left the surface of the extracting means under the effect of a separating force induced by the movement of the extracting means, wherein during step b):

disposing the distinct metallic fibers obtained from the step a) in a mold where they are substantially uniformly compressed for forming said agglomerated mat, in such a way that the gas porosity in the mat is substantially uniform, and wherein, during step c):

exerting a pressure not notably higher than the pressure exerted during step b) to the compressed fibers of said agglomerated mat, connecting the mat of the compressed fibers to electrodes and to a capacitor, and through said electrodes and by electrically discharging the capacitor, heating the compressed fibers at the points where they are in contact to each other, to a temperature higher or equal to their temperature of fusing, for inducing a welding of the fibers to each other, exclusively, under a high voltage, so that the porosity of the mat comprising said fibers welded to each other is substantially uniform and substantially equal to the porosity of the agglomerated mat obtained from step b).

2. The process according to claim 1, wherein during step a), fibers having a content of aluminum comprised between 5.5% and 8% are manufactured.

3. The process according to claim 1, wherein during step a), fibers having a crescent-shaped section are manufactured.

* * * * *